US005605022A

United States Patent [19]

Fulton

[11] Patent Number: 5,605,022

[45] Date of Patent: Feb. 25, 1997

[54] VENTED CLOSURE

[75] Inventor: David A. Fulton, Houston, Tex.

[73] Assignee: NCI Building Systems, Inc., Houston, Tex.

[21] Appl. No.: 576,965

[22] Filed: Dec. 26, 1995

[51] Int. Cl.[6] ..... E04B 7/00

[52] U.S. Cl. ..... 52/199; 52/198; 454/365

[58] Field of Search ..... 52/199, 198; 454/365, 454/366, 900

[56] References Cited

U.S. PATENT DOCUMENTS

| | | | |
|---|---|---|---|
| 2,214,183 | 9/1940 | Seymour . | |
| 3,481,263 | 12/1969 | Belden . | |
| 4,280,399 | 7/1981 | Cunning . | |
| 4,558,637 | 12/1985 | Mason . | |
| 4,788,801 | 12/1988 | Jones . | |
| 4,903,445 | 2/1990 | Mankowski . | |
| 5,002,816 | 3/1991 | Hoffmann et al. . | |
| 5,022,203 | 6/1991 | Boyd | 52/199 |
| 5,095,810 | 3/1992 | Robinson | 454/366 X |
| 5,427,571 | 6/1995 | Sells . | |

FOREIGN PATENT DOCUMENTS

| | | |
|---|---|---|
| 2020724 | 11/1979 | United Kingdom . |

*Primary Examiner*—Lanna Mai
*Assistant Examiner*—W. Glenn Edwards
*Attorney, Agent, or Firm*—Michael A. O'Neil; Russell N. Rippamonti

[57] ABSTRACT

A vented closure for installation in a roofing system between the upper end of a roofing panel and a ridge cap. The vented closure is die-pressed into a cap flange for attachment to the ridge cap; a downwardly disposed closure wall connected to the cap flange; a bottom wall connected to the closure wall; an upwardly disposed inner sidewall connected to the bottom wall; and a vent opening located in the closure wall. Either a screen or a multiplicity of louvers covers the vent opening. The present invention closes the spaces in the ends of the roofing panel and conforms to the profile of the panel in such a way as to prevent entry of water, debris and vermin but permit the passage of air.

15 Claims, 5 Drawing Sheets

VENTED CLOSURE

TECHNICAL FIELD

The present invention relates to roofing vents and, in particular, to an improved vented closure that secures a roof ridge cap to a metal roof panel while integrally providing a vent or vents for the building.

BACKGROUND OF THE INVENTION

Metal roofs are commonly used, especially in commercial and industrial buildings. In existing metal roofing systems, typically a closure piece is attached to the upper end of the roofing panel to seal the space between the upper end of the roofing panel and the ridge cap. The closure piece typically conforms to the profile of the roofing panel. The profile of the roof panel controls the height and width of the closure.

Historically, if a ridge vent was incorporated in the roofing system, the vent was separate from the closure and sat on top of the closure between the closure and the ridge cap.

SUMMARY OF THE INVENTION

The present invention is a vented closure which secures a roof ridge cap to the upper end of a roofing panel while integrally providing a vent or vents for the building. Because the vent is separate from the closure in prior art systems, additional field assembly is required. Labor costs for field assembly are a significant component of total roofing costs. The present invention significantly reduces field assembly time and attenuate cost by combining the closure and vent into a single, shop fabricated piece.

The present invention closes the spaces in the ends of the roofing panels and conforms to the profile of the panel in such a way as to prevent the entry of water, debris, birds and vermin but permit the passage of air. The vented closure of the present invention has a cross section profile similar to a standard roofing gutter. The vented closure is die-pressed into a profile comprising a cap flange, connected to a downwardly disposed closure sidewall with a screened or vented opening, connected to a bottom wall and connected to an upwardly disposed inner side wall terminating in an inwardly projecting lip. The inner sidewall functions as a baffle for preventing rapid air flow and diverting water and debris into the bottom of the vented closure for drainage to the outside. Prior venting systems without such a baffle allow rapid inflow of air which can carry rainwater and debris into the building.

In prior art systems, the roof panel controlled the height and width of the closure. In the present invention, the roof panel controls the width of the closure but the desired cross-sectional area of the vent holes controls the height. The vent cross-sectional area is determined by the desired amount of air flow through the vent. Typically, the building designer or architect will specify the amount of air flow desired in cubic feet per minute.

BRIEF DESCRIPTION OF THE DRAWINGS

A more complete understanding of the present invention and the advantage thereof may be had by reference to the following Detailed Description when taken in conjunction with the accompanying Drawings wherein.

DETAILED DESCRIPTION

Figure 1:
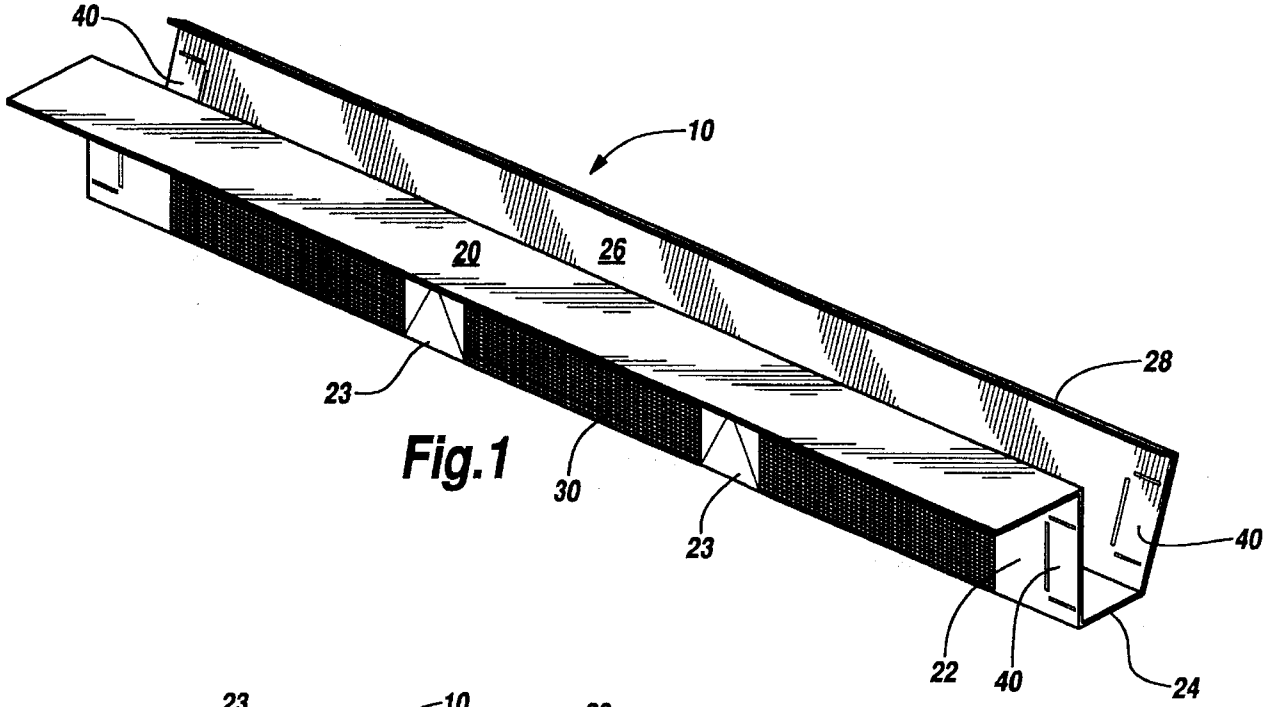
FIG. 1 is a perspective view illustrating a vented closure.
Figure 2:
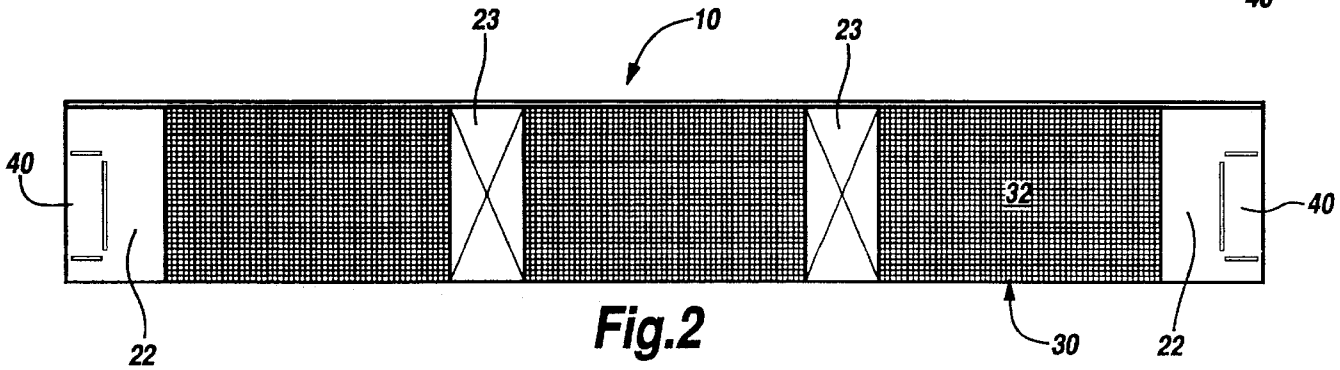
FIG. 2 is a front view illustrating the vented closure.
Figure 3:
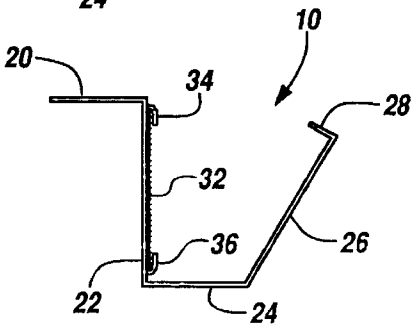
FIG. 3 is an end view of the vented closure.

Reference is now made to the Drawings wherein like reference characters denote like or similar parts throughout the thirteen Figures. FIGS. 1–3 illustrate the vented closure 10 of the present invention. Referring to FIGS. 1 and 3, the vented closure 10 has an end profile similar to a conventional roofing gutter. The vented closure 10 is die-pressed into an end profile comprising a cap flange 20, connected to a downwardly disposed closure sidewall 22, connected to a bottom wall 24, connected to an upwardly disposed inner side wall 26 and terminating in an inwardly projecting lip 28. Closure sidewall 22 includes openings 30 covered with screen 32. Screen 32 is held in place by upper screen clamp 34 and lower screen clamp 36. Screen clamps 34 and 36 are formed integrally with sidewall 22 from a portion of the metal pressed from opening 30.

Figure 4:
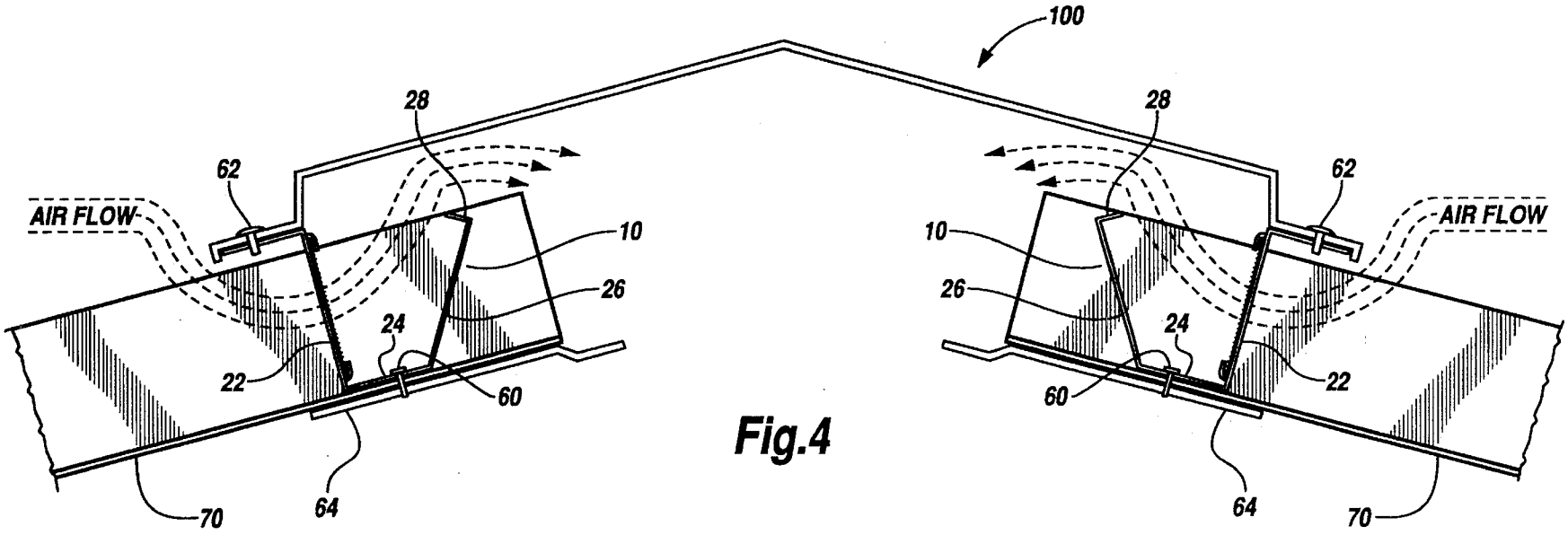
FIG. 4 is an end view of the vented closure illustrating the vented closure installed in a typical roofing system.
Figure 13:
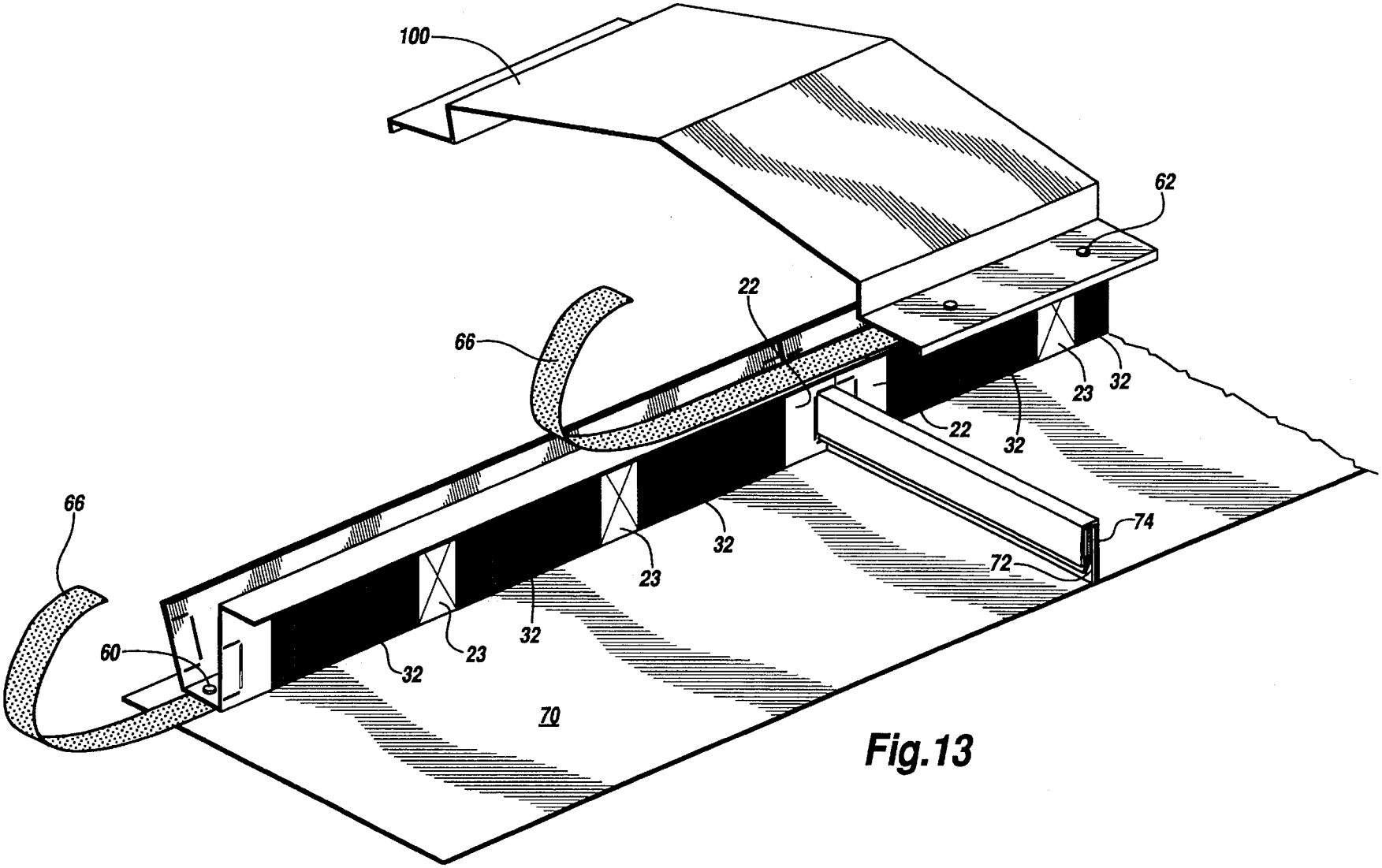
FIG. 13 is a perspective view illustrating the vented closure installed in a VERTI-LOC™ roofing system.

Referring now to FIGS. 4 and 13, the vented closure 10 is illustrated in use in a typical roofing system. Historically, ridge vents were separate from the closure and sat on top of the closure. Because the vent was separate from the closure in prior art systems, additional field assembly is required. Labor costs for field assembly are a significant component of total roofing costs. The vented closure 10 of the present invention significantly reduces field assembly time and attenuate cost by combining the closure and vent into a single shop-fabricated piece.

Vented closure 10 rests on roof panel 70 which rests on back-up plate 64 or directly on the purlin. A standard first fastener 60 passes through the bottom wall 24 of the vented closure 10, through the roofing panel 70 and affixes the vented closure to back-up plate 64 and/or the purlin. A second fastener 62 affixes the ridge cap 100 to the vented closure 10.

Air flow through the vented closure is indicated in FIG. 4. The inner sidewall 26 functions as a baffle for preventing rapid air flow and diverting water and debris into the bottom of the vented closure 10 for drainage to the outside. Prior venting systems without such a baffle allow rapid inflow of air which can carry rainwater and debris into the building. The inwardly projecting lip 28 functions as an additional baffle to direct rainwater and debris downward into the bottom of the vented closure 10 for drainage outside the building.

Returning to FIG. 2, a front view of closure sidewall 22 of vented closure 10 is illustrated. Openings 30 are periodically spaced along the closure sidewall 22. Screens 32 cover each opening 30 and prevent birds, vermin and debris from entering the building. Solid spacer portions 23 are located between the openings 30 along closure sidewall 22.

In prior art systems, the roof panel controlled the height and width of the closure. In the present invention, the width of the closure is determined by the roof panel profile but the height is controlled by the desired cross-sectional area of the vent hole. The vent cross-sectional area is determined by the desired amount of air flow through the vent.

Figure 7:
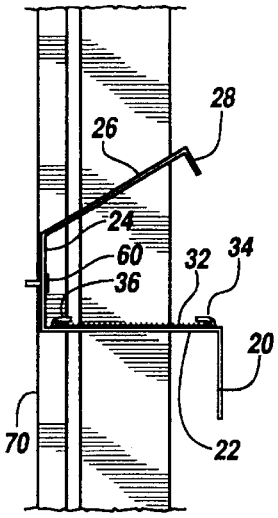
FIG. 7 is a detailed end view of the first embodiment of the vented closure.
Figure 6:
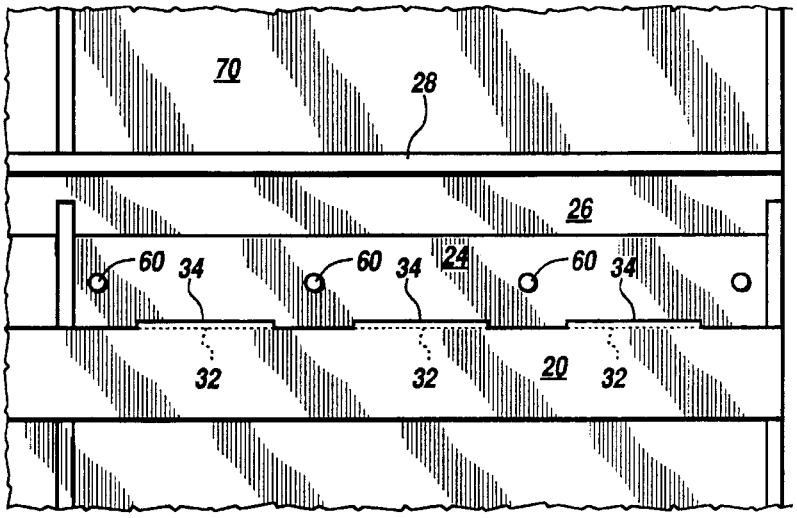
FIG. 6 is a detailed top view of the first embodiment of the vented closure.
Figure 5:
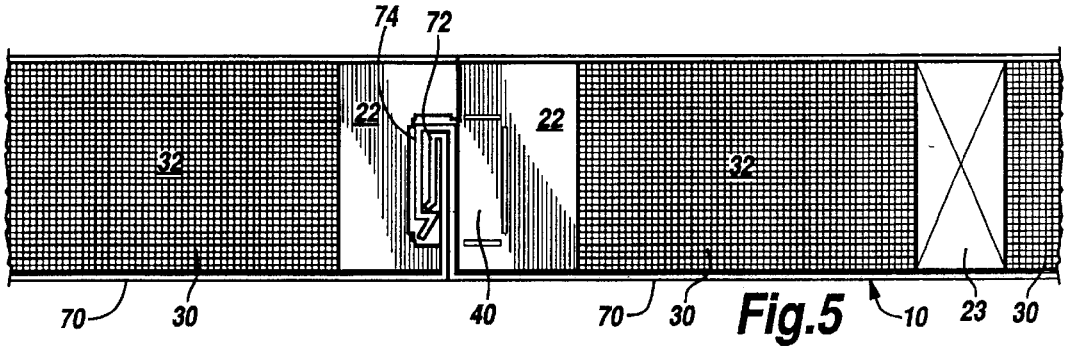
FIG. 5 is a detailed front view of a first embodiment of the vented closure for use with a VERTI-LOC™ roofing system.

Referring to FIGS. 5–7, there are illustrated detailed front, top and end views of a specific embodiment of the vented closure for use with a VERTI-LOC™ roofing panel 70 manufactured by NCI Building Systems, Inc of Houston, Tex. On one side of the VERTI-LOC™ panel 70 is a male locking member 72 and on the opposite side is a female locking member 74. Adjacent panels 70 are secured together by a locking joint comprised of the male locking member 72 of a first panel being received in the female locking member 74 of an adjacent panel. Break out tabs 40 are located on each end of the closure sidewall 22. When the vented closure 10 is installed, a break out tab 40 is removed to enable the vented closure to fit around the locking joint of the roofing panel 70. FIG. 13 illustrates vented closure 10 installed in a VERTI-LOC™ roofing system. Sealant tape 66 may be installed between the roofing panel 70 and the vented closure 10 and between the vented closure and the ridge cap 100.

Figure 8:
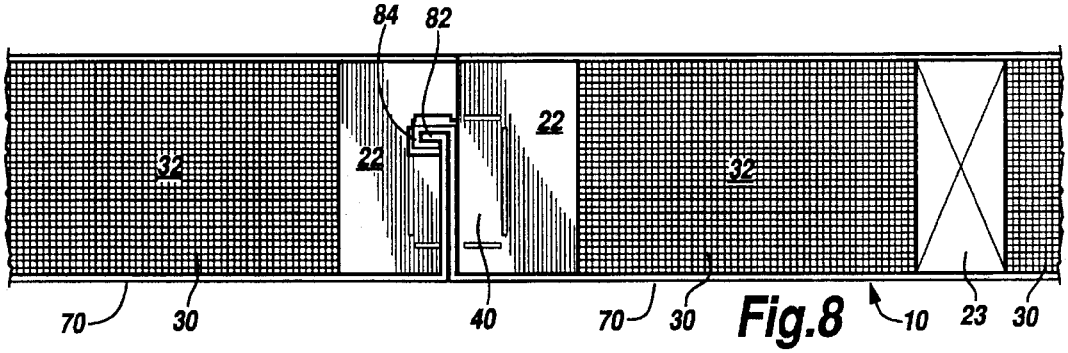
FIG. 8 is a detailed front view of a second embodiment of the vented closure for use with a SS-216™ roofing system.

FIG. 8 illustrates a second embodiment of the vented closure 10 for use with a SS-216™ roofing system manufactured by NCI Building Systems, Inc. The vented closure is fabricated and installed in the same fashion as was previously described for the first embodiment. The only notable difference being that the breakout tab 40 is sized to conform to the profile of the SS-216™ joint formed by male locking member 82 and female locking member 84 of roofing panel 80.

Figure 9:
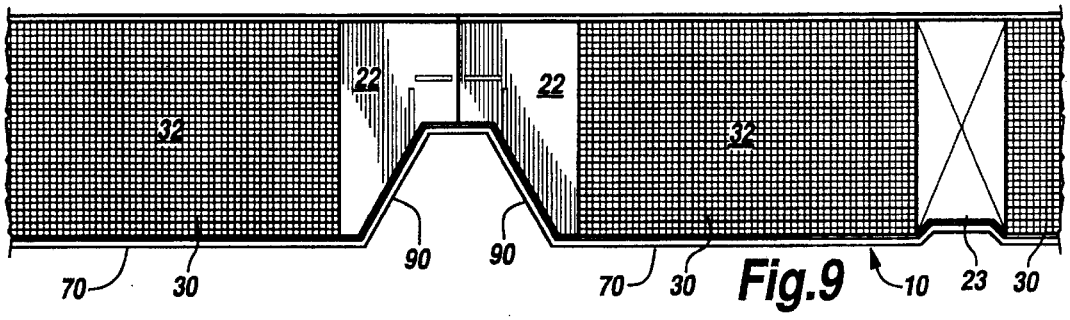
FIG. 9 is a detailed front view of a third embodiment of the vented closure for use with a R-PANEL roofing system.

FIG. 9 illustrates a third embodiment of the vented closure 10 for use with a standard industry R-panel roofing system. The vented closure is fabricated and installed in the same fashion as was previously described for the first embodiment. There are several notable differences. Instead of breakout tabs, the end of closure sidewall 22 is sized to conform to the profile of the R-joint formed when the edge of a first R-panel 90 overlaps the edge of the adjacent panel 90. Additionally, spacer portions 23 of closure wall 22 are located and sized to conform to minor ribs in the profile of the R-panel 90.

Figure 10:
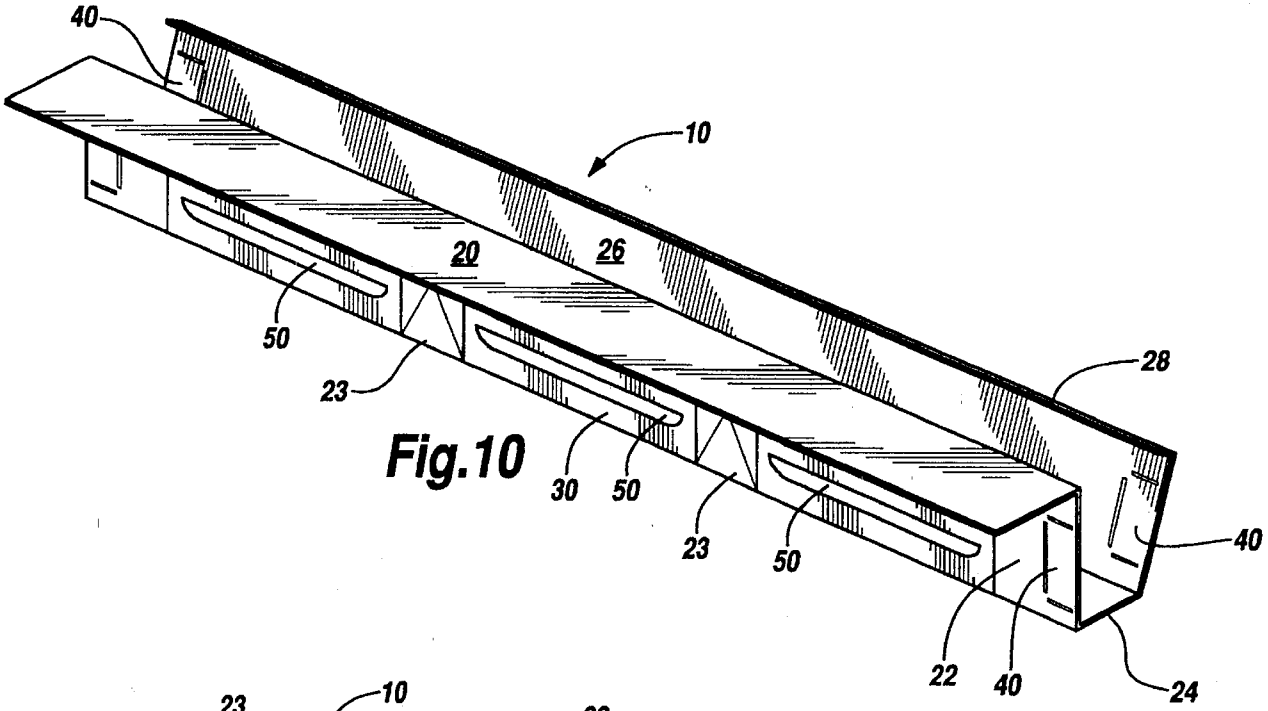
FIG. 10 is a detailed perspective view of an alternative embodiment of the vented closure.
Figure 11:
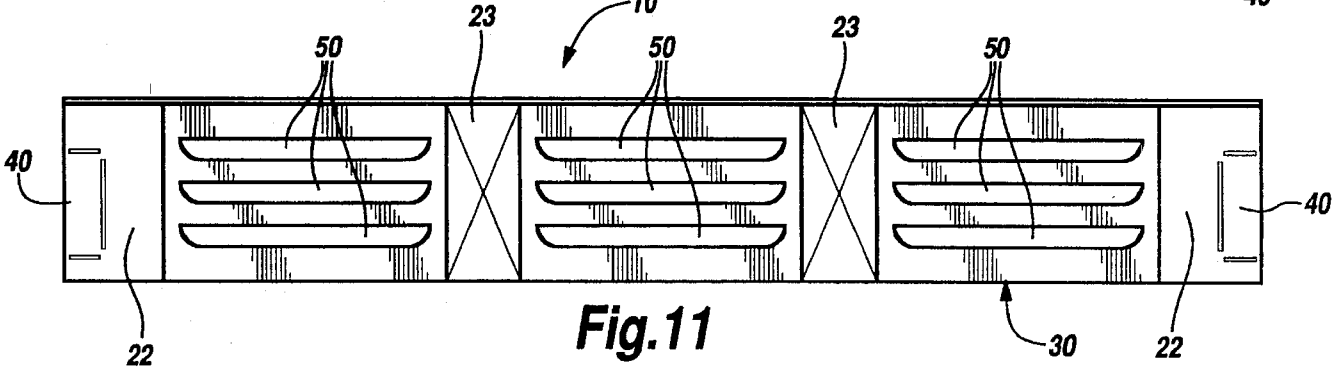
FIG. 11 is a detailed front view of the alternative embodiment of the vented closure.
Figure 12:
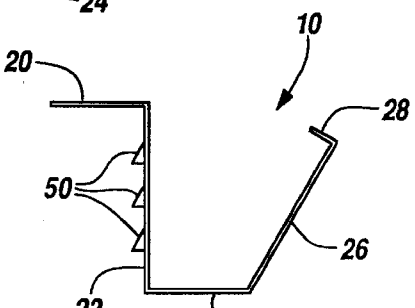
FIG. 12 is a detailed end view of the alternative embodiment of the vented closure.

Turning now to FIGS. 10 through 12, wherein an alternative embodiment of the vented closure 10 is illustrated. The vented closure 10 is fabricated and installed in the same fashion as was previously described for the first embodiment with the following differences. Instead of opening 30 being covered by a screen 32, a multiplicity of outwardly and downwardly disposed louvers 50 are pressed from closure wall 22. The louvers exclude birds, vermin, and debris form the building. The louvers 50 are grouped in sets separated by spacer portions 23 along closure wall 23.

Although several embodiments of the invention have been illustrated in the accompanying Drawings and described in the foregoing Detailed Description, it will be understood that the invention is not limited to the embodiment disclosed but is capable of numerous modifications without departing from the scope of the invention as claimed.

I claim:

1. A vented closure for installation in a roofing system, said roofing system including a roofing panel and a ridge cap, said vented closure being located between an upper end of the roofing panel and the ridge cap, wherein said vented closure comprises:

a cap flange for attachment to the ridge cap;

a downwardly disposed closure wall connected to the cap flange;

a bottom wall, connected to the closure wall, said bottom wall attached to the upper end of the roofing panel;

an upwardly disposed inner sidewall connected to the bottom wall, thereby forming an open topped trough;

a vent opening located in said closure wall; and means for excluding birds, vermin and debris, covering said vent opening.

2. The vented closure of claim 1 wherein the inner side wall terminates in an inwardly projecting lip.

3. The vented closure of claim 1 where the means for excluding birds, vermin and debris includes:

a screen; and an upper screen clamp and a lower screen clamp formed integrally with the closure wall from a portion of closure wall material removed from the closure wall when the opening is created.

4. The vented closure of claim 1 where the means for excluding birds, vermin and debris includes:

a multiplicity of outwardly and downwardly disposed louvers covering said vent opening.

5. The vented closure of claim 4 wherein the louvers are formed integrally with the sidewall.

6. A vented closure for installation in a roofing system, said roofing system including a roofing panel, a ridge cap and a roofing joint, said roofing joint formed by a male locking member disposed on a side edge of a first panel being received into a female locking member disposed on a side edge of an adjacent panel, said vented closure being located between an upper end of the panel and the ridge cap, wherein said vented closure comprises:

a cap flange for attachment to the ridge cap;

a downwardly disposed closure wall connected to the cap flange;

a bottom wall, connected to the closure wall, said bottom wall attached to the upper end of the roofing panel;

an upwardly disposed inner sidewall connected to the bottom wall, thereby forming an open topped trough;

a vent opening located in said closure wall;

means for excluding birds, vermin and debris, covering said vent opening; and a break out tab disposed on an end of the closure wall, said break out tab sized for enabling the end of the closure wall to fit around said roofing joint.

7. The vented closure of claim 6 wherein the inner side wall terminates in an inwardly projecting lip.

8. The vented closure of claim 6 where the means for excluding birds, vermin and debris includes:

a screen; and an upper screen clamp and a lower screen clamp formed integrally with the closure wall from a portion of closure wall material removed from the closure wall when the opening is created.

9. The vented closure of claim 6 where the means for excluding birds, vermin and debris includes:

a multiplicity of outwardly and downwardly disposed louvers covering said vent opening.

10. The vented closure of claim 9 wherein the louvers are formed integrally with the sidewall.

11. A vented closure for installation in an R-panel roofing system, said roofing system including an R-panel roofing panel, a ridge cap and a R-panel joint, said R-panel joint formed by a side edge of a first R-panel overlapping a side edge of an adjacent R-panel, said vented closure being located between an upper end of the R-panel and the ridge cap, wherein said vented closure comprises:

a cap flange for attachment to the ridge cap;

a downwardly disposed closure wall connected to the cap flange, said closure wall terminating with an end profile enabling the vented closure to fit adjacent to the R-panel joint;

a bottom wall, connected to the closure wall, said bottom wall attached to the upper end of the R-panel roofing panel;

an upwardly disposed inner sidewall connected to the bottom wall, thereby forming an open topped trough;

a vent opening located in said closure wall; and means for excluding birds, vermin and debris, covering said vent opening.

12. The vented closure of claim 11 wherein the inner side wall terminates in an inwardly projecting lip.

13. The vented closure of claim 11 where the means for excluding birds, vermin and debris includes:

a screen; and an upper screen clamp and a lower screen clamp formed integrally with the closure wall from a portion of closure wall material removed from the closure wall when the opening is created.

14. The vented closure of claim 11 where the means for excluding birds, vermin and debris includes:

a multiplicity of outwardly and downwardly disposed louvers covering said vent opening.

15. The vented closure of claim 10 wherein the louvers are formed integrally with the sidewall.

* * * * *